US005402591A

United States Patent [19]

Lee

[11] Patent Number: 5,402,591

[45] Date of Patent: Apr. 4, 1995

[54] INFLATABLE AND DEFLATABLE SIGN SUPPORT

[76] Inventor: Randy L. Lee, 205 N. River, Saginaw, Mich. 48609

[21] Appl. No.: 2,722

[22] Filed: Jan. 11, 1993

[51] Int. Cl.[6] ..... G09F 15/00

[52] U.S. Cl. ..... 40/610; 248/160; 40/584

[58] Field of Search ..... 248/162.2, 440.1, 160; 40/610, 606, 617, 584, 212, 214, 217

[56] References Cited

U.S. PATENT DOCUMENTS

| | | | |
|---|---|---|---|
| 2,134,063 | 10/1938 | Turchanyi | 446/221 |
| 2,826,000 | 3/1958 | Fischman et al. | 446/223 X |
| 2,991,589 | 7/1961 | Ayala | 446/220 X |
| 3,686,782 | 8/1972 | Erickson et al. | 40/152 |
| 3,729,847 | 5/1973 | Chandos . | |
| 3,771,247 | 11/1973 | DeHarak | 40/152 |
| 4,162,106 | 7/1979 | Lawrence et al. | 446/220 X |
| 4,179,832 | 12/1979 | Lemelson | 446/220 X |
| 4,776,121 | 10/1988 | Vicino | 40/610 |
| 4,817,319 | 4/1989 | Vitale | 40/610 |
| 4,837,958 | 6/1989 | Radovich | 40/538 |
| 4,885,858 | 12/1989 | Strom | 40/538 |
| 4,995,186 | 2/1991 | Collie | 40/591 |
| 5,024,012 | 6/1991 | Lovik | 40/212 |
| 5,031,299 | 7/1991 | Lovik . | |
| 5,141,463 | 8/1992 | Rouse, Jr. | 446/222 X |

FOREIGN PATENT DOCUMENTS

| | | | |
|---|---|---|---|
| 377636 | 8/1922 | Germany | 40/214 |

*Primary Examiner*—Kenneth J. Dorner
*Assistant Examiner*—Cassandra Davis
*Attorney, Agent, or Firm*—John J. Swartz

[57] ABSTRACT

An inflatable and deflatable support for a sign having advertising indicia thereon including an air inflatable, cylindrical member having an upper, inflatable, cylindrical cross member spanning a pair of upstanding inflatable legs which depend from opposite ends thereof. The legs are each open at the lower end and are sealed to a hollow cylindrical ballast plug. Mechanism is coupled to one of the legs and cylinders for admitting air under pressure to the cylindrical ballast plug to inflate and deflate the cylinder.

21 Claims, 3 Drawing Sheets

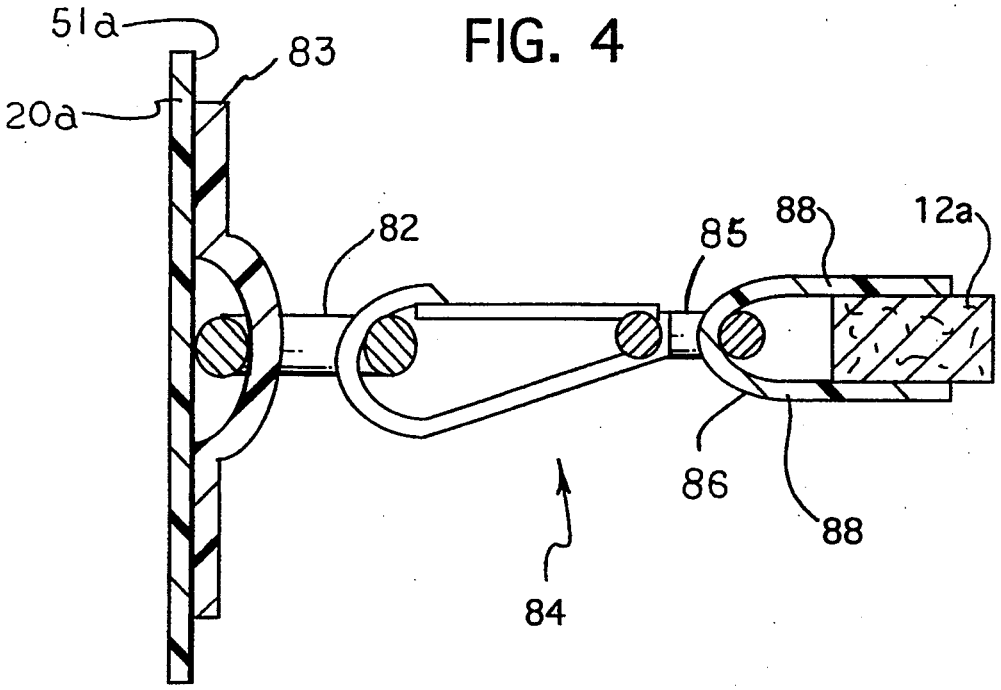
FIG. 4
FIG. 5
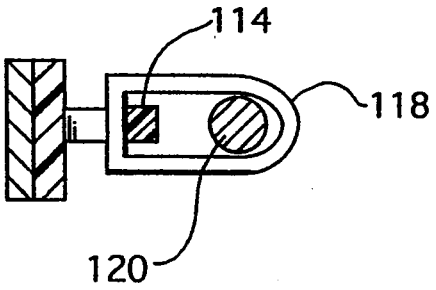
FIG. 6
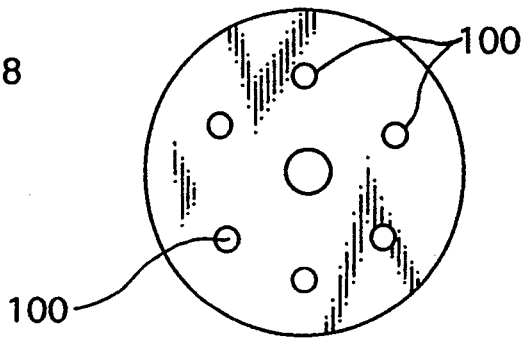

INFLATABLE AND DEFLATABLE SIGN SUPPORT

BACKGROUND OF THE INVENTION

1. Field of the Invention

This invention relates to an advertising sign and more particularly to an inflatable and deflatable, self-supporting, generally inverted U-shaped sign support.

2. Description of the Prior Art and Objects

Advertising signs have been supported by various structural members such as billboards, walls, ground embedded posts and various other mechanical supports. Sign supports which are permanent, such as billboards, are sometimes constructed of steel girders embedded in concrete. Portable sign supports, such as those utilized by realtors in selling real estate, may include vertical rods which are detachably embedded in the ground.

With portable signs, which are periodically moved, the weight of the sign support is an important factor. Another important factor in the construction of a portable sign, is the size of a vehicle or trailer required to move the portable sign. A third factor is the expense and difficulty in erecting and dismantling a portable sign. Accordingly, it is an object of the present invention to provide a new and novel lightweight, inexpensive sign support which is easy to erect and dismantle.

A sign, which is inflatable and deflatable, can be compacted into a relatively small volume for storage and transfer. Inflatable signs have been provided heretofore such as a balloon, or other such inflatable device, having an advertisement written thereon. One such expandable balloon as illustrated in U.S. Pat. No. 5,024,012 issued to Craig J. Lovik on Jun. 18, 1991, and U.S. Pat. No. 5,031,299 issued to Mr. Lovik on Jul. 16, 1991. Such an expandable balloon has the advertising displayed thereon and is not utilized as a support for a separate sign. Another inflatable sign of a similar type is disclosed in U.S. Pat. No. 4,776,121 granted to Robert K. Vicino on Oct. 11, 1988.

An inflatable closed loop tube which has been utilized as a support for a display sign is illustrated in U.S. Pat. No. 3,729,847 granted to Lurence R. Chandos on May 1, 1973. This prior art construction is not self-supporting but is mounted on a standard support rod and is of limited use. U.S. Pat. No. 4,837,958 issued to JoAnn K. Radovich on Jun. 13, 1989 discloses a specious inflatable, animal-like display figure utilized to support a sign.

It is another object of the present invention to provide a new and novel, inflatable and deflatable, self supporting sign support for supporting a sign.

Still another object of the present invention to provide an inflatable and deflatable inverted U-shaped sign support which, when inflated, is self-supporting.

A further object of the present invention is to provide a sign support of the type described comprising an air impervious inflatable tube including a pair of upstanding tubular support legs having open lower ends and at least one lower end being closed by an air impervious ballast.

A still further object of the present invention to provide a sign support of the type described including an impervious inflatable and deflatable tube having a pair of upstanding tubular legs which include open lower ends that are closed by a pair of plugs having hollow cylindrical side walls sealed to the lower ends of the legs.

Another object of the present invention is to provide an inflatable sign support including an inflatable casing having a tubular cross member and a pair of integral tubular legs which, when inflated, hold the cross member in spaced relation with the ground.

Another object of the present invention is to provide a new and novel portable, inflatable sign support which has at least one transparent window.

It is another object of the present invention to provide a new and novel inflatable portable sign support of the type described including decorating streamers which are coupled to the sign support for attracting viewers.

Other objects and advantages of the present invention will become apparent to those of ordinary skill in the art as the

SUMMARY OF THE INVENTION

An inflatable and deflatable, portable sign support comprising: an inverted U-shaped, self-supporting, inflatable, air impervious tube having a pair of open lower ends; a ballast closes at least one of the lower ends; and mechanism is provided for admitting pressurized air to the other of the lower ends to inflate the tube.

DESCRIPTION OF THE DRAWINGS

The invention may be more readily understood by referring to the accompanying drawings, in which:

FIG. 4 is an enlarged sectional plan view taken along the line 4—4 of FIG. 3 and more particularly illustrating the apparatus for mounting a sign on the casing;

FIG. 5 is an enlarged plan view, taken along the line 5—5 of FIG. 3 and more particularly illustrating the structure for detachably coupling the casing to the ground; and FIG. 6 is a top plan view, taken along the line 6—6 of FIG. 3.

DESCRIPTION OF THE PREFERRED EMBODIMENT

Figure 1:
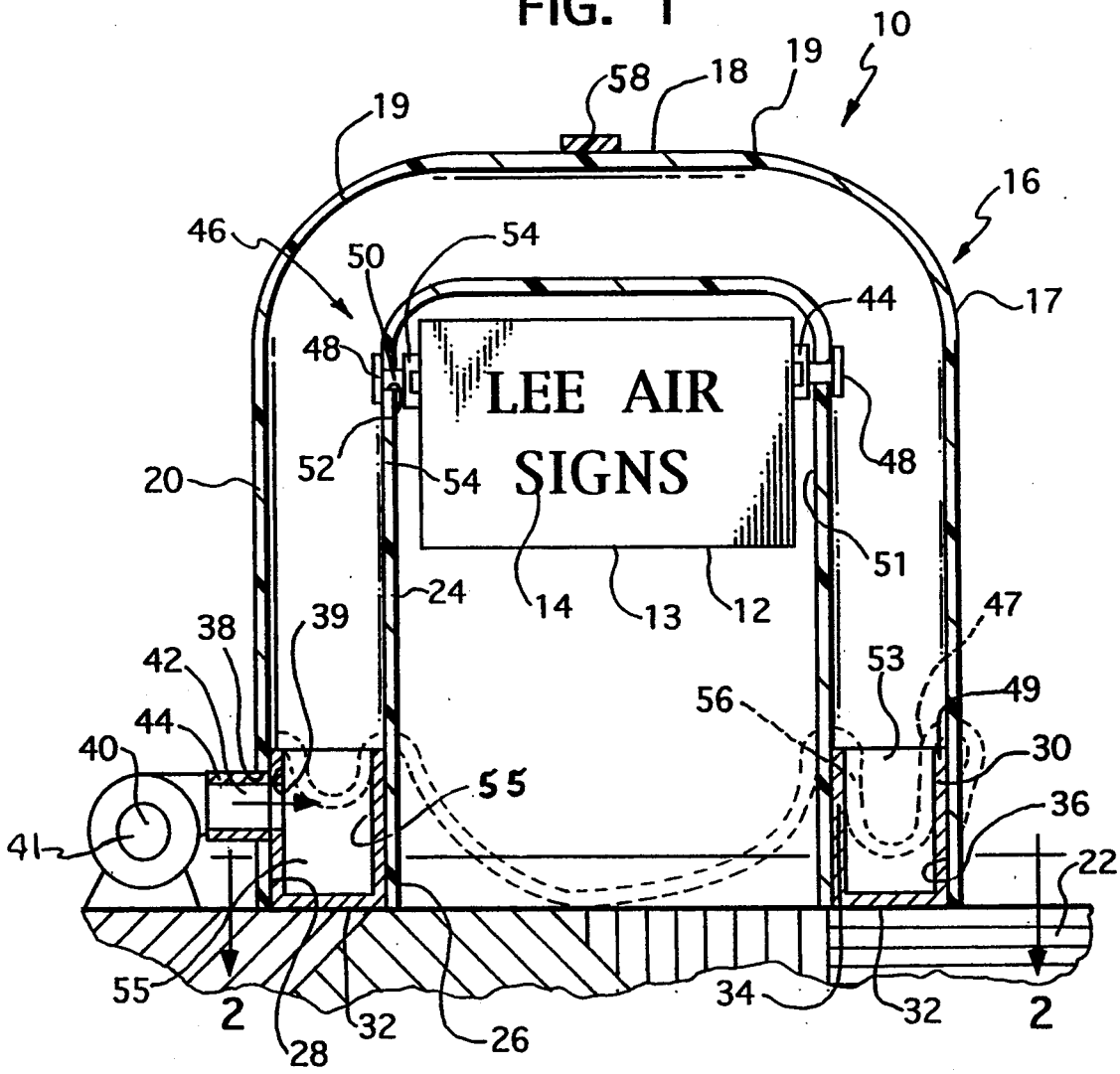
FIG. 1 is a front sectional view of sign support apparatus constructed according to the present invention.

Inflatable sign support apparatus, generally designated 10, is provided for mounting a sign, generally designated 12, including a panel or sheet 13 bearing advertising indicia 14 thereon. The sign support apparatus 10 includes an air impervious, inflatable, inverted U-shaped, self-supporting casing or tube, generally designated 16, including an upper generally cylindrical cross member 18 and a pair of lower, laterally spaced apart, inflatable cylindrical legs, generally designated 20, integrally coupled at their upper ends 17 to opposite ends 19 of cross member 18. When the tube 16 is inflated, the legs 20 will support the upper cross member 18 in spaced relation with the ground or support surface 22.

The casing or tube 16 is formed from a flexible hollow cylindrical sheet having a side wall 24 which, when inflated, will assume the inflated, sign supporting position, illustrated in solid lines in FIG. 1, and when deflated, will be collapsed to the deflated position, illustrated in chain lines in FIG. 1.

The cylindrical legs 20 include open lower ends 26 having downwardly opening, openings 28 which receive air impervious, portable ballasts or plugs, generally designated 30, each having a bottom end wall 32 and an integral cylindrical side wall 34 sealed to the inner lower surface 36 of the lower tube ends 26. The ballasts 30 have a density substantially greater than the density of the tube 16. The ballasts 30, which are substantially heavier than the tube 16, stabilize the sign support and minimize the effects of any wind.

One of the cylindrical side walls 34 includes an aperture 38 therein in alignment with an opening 39 provided in the lower end 26 of one of the legs 20. A motor driven fan, generally designated 40, is provided for directing pressurized air, represented by the arrow 42, to the casing 16 via a hollow conduit or nipple 44 which is in open fluid communication with the aligned openings 38 and 39. The ballast 30 acts as a closure or stop for the open lower end 26 and forces the air, admitted in the direction of the arrow 42, upwardly into the casing 16 to inflate the casing 16. When the motor driven fan 40 is operated, it will introduce sufficient air into one of the legs adjacent the lower end thereof, to maintain a static pressure within the casing 16 in excess of the ambient atmospheric pressure and cause the casing 16 to upwardly elevate from the deflated position, illustrated in chain lines in FIG. 1, to the raised, self-supporting inflated position illustrated in solid lines in FIG. 1.

The sign 12 is mounted on the casing 16 with fasteners, generally designated 46 which, may suitably comprise a pair of opposing male studs 48, having generally horizontally aligned, opposing horizontal posts 50 sealingly received in opposing openings 52, provided in the laterally inner, opposing sides 51 of the legs 20. The fasteners 46 include complimentally shaped, laterally outwardly extending female receptacles 54, which are fixed to the opposite ends of the sign sheet 13, and detachably, frictionally receive the male posts 50.

When the casing 16 is deflated, a portion 56 thereof will fall under the force of gravity or be manually stuffed into the upper open ends 53 of the plugs 30. A portion 47 of the casing 16 will drape over the upper plug edge 49 to allow the user to manually grasp the draped casing portion 47 and the upper edge 49 and manually move the entire portable sign support 10 to another location.

If desired, a suitable closure plug (not shown) may be utilized to immediately close the nipple 44 after the fan 40 is disconnected therefrom. If the fan is disconnected and all of the openings sealed, the sign will be maintained in the position shown. On the other hand, if desired, the fan can continue to operate to maintain the static pressure within the casing 16 at a predetermined level.

The portable sign support apparatus 10 is lightweight, inexpensive, easy to erect and easy to dismantle. The portable ballasts 30 assist in holding the relatively lightweight casing 16 in position to minimize the effect of wind or to preclude it from being easily knocked over. If desired, safety straps, generally designated 58, may be used to tie the casing 16 to ground embedded anchors.

THE OPERATION

Initially, it will be assumed that the casing 16 is in the collapsed position illustrated in chain lines in FIG. 1. In this position, at least a portion 56 of the outer wall of the casing will be draped or manually stuffed into the inside 55 of the cylindrical ballasts 30, in the position illustrated in chain lines, so that the user may manually grasp the upper open edges 49 of the ballasts 30 to easily carry the sign support 10 and move it to different locations. The sign is lightweight and easily portable.

The sign support 10, including the casing 16 and the cylindrical closure ballasts 30, will be moved to appropriate position and the motor 41 will be operated to drive the fan 40 and force air inwardly into the casing 16 in the direction of the arrow 42. This will cause the casing 16 to inflate and the legs 20 will expand to the inflated position, illustrated in solid lines in FIG. 1, to raise the cross member 18 to the sign supporting position, illustrated in FIG. 1 to be self-supporting.

The casing 16, which is flexible, will allow the male stud fasteners 48 to be temporarily pushed laterally outwardly to slightly laterally spaced positions from that illustrated in FIG. 1 to allow the male fasteners 50 to receive the female fastener receptacles 54 to support the sign 12 as illustrated. As soon as the separating force is removed, the casing 16 will return under its own memory to the position illustrated in solid lines in FIG. 1.

When the sign is to be dismantled, air pressure provided by motor 41 and the fan 40 is released or removed and the casing 16 will again collapse to the deflated position, illustrated in chain lines in FIG. 1. The casing portions 51 and 47 will again drape into the ballast cylinders 30 so that the user can easily grasp the casing 16 and upper cylinder edges 49 of ballasts 30 to move the portable sign support 10 and sign 12 to another location.

MODIFIED EMBODIMENT

Referring now more particularly to FIGS. 3–6, a slightly modified inflatable and deflatable sign support apparatus, generally designated **10*a*, is illustrated. Similar parts will be designated with similar reference characters followed by the letter "a" subscript. Each of the legs 20*a* includes a circular band 60 of transparent material having upper and lower edges 62 and 64 sewn or heat sealed to inwardly disposed confronting flange portions 66 and 68 of the flexible hollow side wall 24*a*. The casing side wall 24*a* comprising opaque vinyl material whereas the band 60 comprises clear transparent or translucent material which allows the public to view the inside thereof. Advertising media, such as a sign 70 may be disposed on the inside 72 of the band 60** for additional advertising for decoration.

A light bulb, 74, coupled to an electrical wire 76 which is suitably coupled to a source 78 is provided for illuminating the inside of the transparent band 60. The electrical cord 76 may be coupled to any suitable source of power and passes through an opening 80 in the bottom end wall **32*a* of the ballast or plugs 30*a***.

Figure 2:
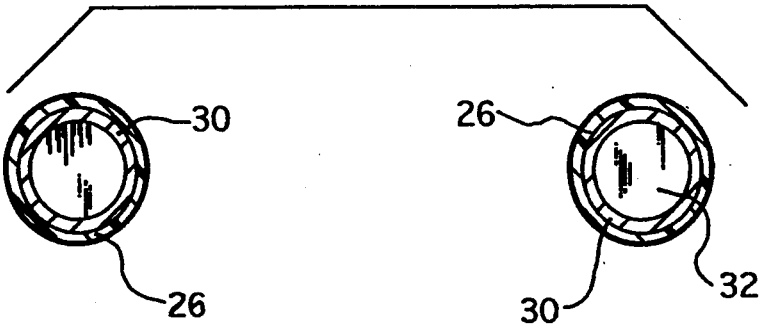
FIG. 2 is a sectional plan view taken along the line 2—2 of FIG. 1.

The apparatus illustrated in FIGS. 3–6 also differs from the apparatus illustrated in FIGS. 1 and 2 in that the fasteners, generally designated **46*a*, for mounting a sign 12*a* on the legs 20*a* include D-rings 82 coupled to the inner surfaces 51*a* of the legs 20*a* via horizontal plastic strips 83 which is sealed at opposite ends to surface 51*a*. A snap fastener, generally designated 84, is detachably coupled to the D-ring 82 and includes, at its inner end, a ring 85 for receiving a U-shaped band 86 that is sealed at 88 to opposite, front and rear, sides of the sign 12*a***.

Figure 3:
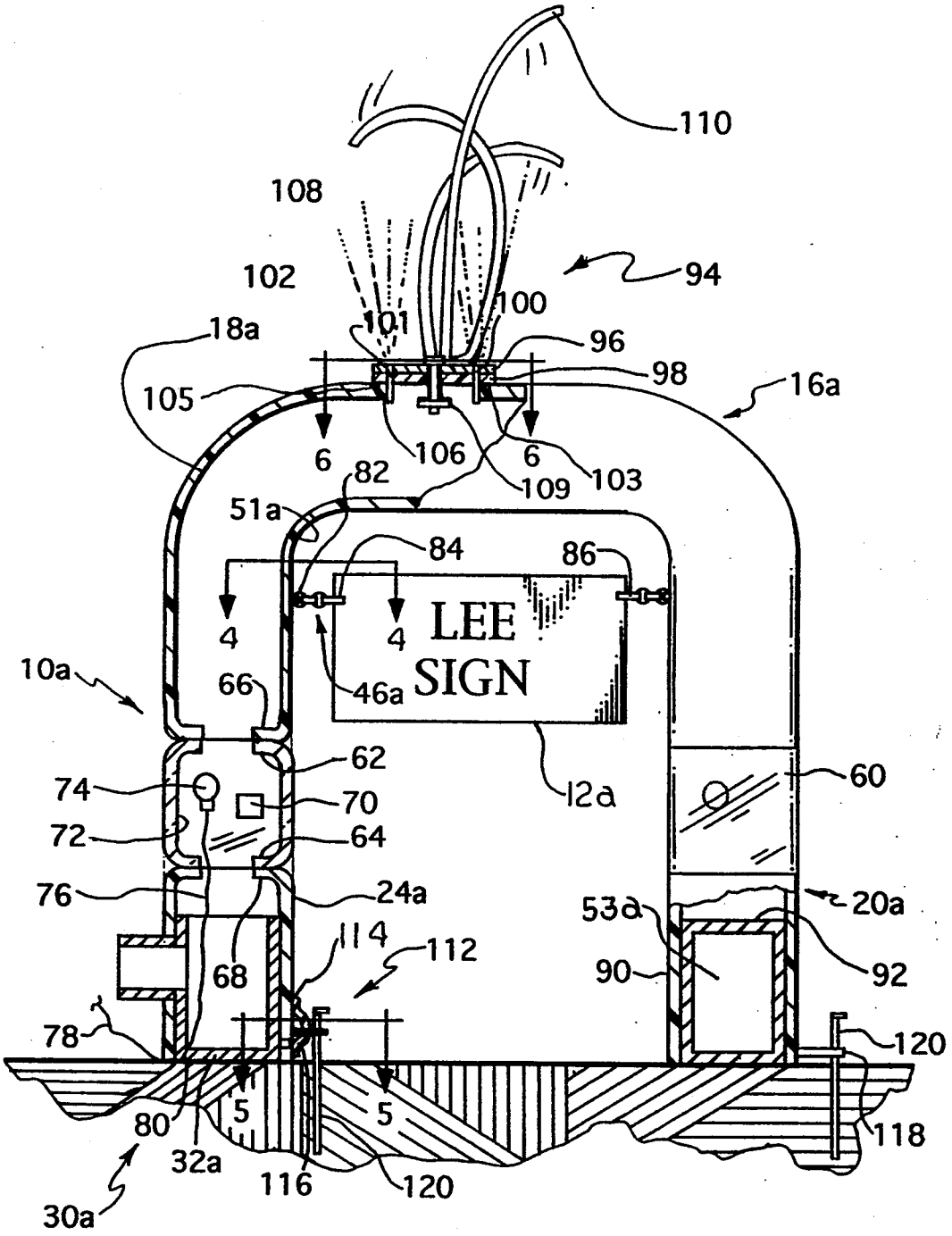
FIG. 3 is a front elevational view of a slightly modified embodiment of sign support apparatus constructed according to the present invention, part of the casing being broken away in section to more clearly illustrate other portions of the apparatus.

As illustrated in the right side of FIG. 3, one of the ballasts 90 differs from the ballast in the embodiment illustrated in FIGS. 1 and 2 in that the upper end 53*a* thereof is closed by a top wall 92.

Apparatus is also provided for decorating the sign support and includes an air outlet valve, generally designated 94, having upper and lower plates 96 and 98 having a plurality of circumferentially spaced apertures 100 and 101, respectively, which can be moved into and out of alignment to allow the passage of air therethrough, as represented by the arrow 102, when the ports 100 and 101 are in alignment.

The lower plate 98 is sealed about its edge 103 to the border portion 105 of an aperture 106 cut into the casing wall 18*a*. A bolt 108 and nut 109 are provided for selectively clamping the plates 96 and 98 in any selected one of a plurality of relatively rotated positions. When the ports 100 and 101 are not in alignment, air will not pass through the aligned passages in the direction of the arrow 102.

A streamer, generally designated 110, is coupled to the head of bolt 108 so that the air egressing through the aligned ports in the direction of the arrow 102, will impale the streamer and cause it to flutter and attract attention to the sign.

Apparatus, generally designated 112, is also provided for further stabilizing the sign support 10a and includes a vertically extending strip 114 sealed at opposite ends to the outer surface of the casing to the outer lower surface 116 of the side wall 24*a*. A d-ring 118 is received by the central portion 120 of strip 114 and receives a stake 120 which is embedded in the ground.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An inflatable and deflatable, portable sign support comprising:

an inverted U-shaped self-supporting, inflatable, air impervious hollow tube having a pair of open lower ends;

ballast means closing at least one of said open lower ends; and means for admitting pressurized fluid to said tube adjacent the other one of said lower ends to inflate said tube;

said ballast means including a cylindrical plug having an end wall and a cylindrical side wall in sealed relation with an end portion of said at least one of said open lower end.

2. The inflatable and deflatable sign support set forth in claim 1 wherein means is provided through said sidewall in at least one of said lower ends of said tube and said plug received thereby for admitting fluid to said tube to inflate said tube.

3. A collapsible, portable sign support comprising:

a hollow, air impervious, air inflatable casing including a hollow, inflatable, cylindrical cross member having open opposite ends and a pair of hollow inflatable cylindrical legs each having an upper open end integral with, and in open fluid communication with, one open end of said cross member and an open lower terminal end for bearing against an underlying support surface;

said legs being moveable between a collapsed, deflated condition and an upstanding inflated condition to raise said cylindrical cross member relative to said open lower ends to a position spaced from said support surface; and means for admitting pressurized air to said casing to inflate said casing and cause said legs to move from said collapsed condition to said inflated condition; and closure means for closing the open lower ends to preclude the escape of air therethrough; comprising a pair of plugs having cylindrical side walls received by the lower ends in sealing engagement therewith.

4. An inflatable and deflatable, portable sign support for supporting a sign, said support comprising:

a hollow air impervious inflatable casing having an upper inflatable portion and integral inflatable leg portions, having upper and lower ends, depending therefrom for supporting, when inflated, said upper inflatable portion in spaced relation with said lower ends of said leg portions; and one opening provided in said lower end of at least one of said leg portions;

means for closing said opening sealed to said lower end of said one of said leg portions;

means for admitting pressurized fluid to said casing to inflate said casing;

said means for closing said opening includes a hollow ballast;

said means for admitting pressurized fluid being coupled to said ballast.

5. An inflatable and deflatable, portable sign support for supporting a sign, said support comprising:

a hollow air impervious inflatable casing having an upper inflatable portion and integral inflatable leg portions, having upper and lower ends, depending therefrom for supporting, when inflated, said upper inflatable portion in spaced relation with said lower ends of said leg portions;

one opening provided in said lower end of at least one of said leg portions;

means including a hollow ballast, for closing said opening sealed to said lower end of said one of said leg portions;

means for admitting pressurized fluid to said casing to inflate said casing;

said means for admitting pressurized fluid is coupled to said ballast;

means for detachably mounting a sign on said tube including a ring and a fastener detachably coupled to said ring;

means for coupling one of said ring and said fastener to said casing; and means for detachably coupling the other of said ring and said fastener to said sign.

6. The inflatable and deflatable portable sign support set forth in claim 5 wherein said means for coupling one of said ring and said fastener to said casing comprises a strip of material having opposite ends sealed to said casing and an intermediate portion spaced from said casing for receiving a portion of said one of said ring and said fastener.

7. An inflatable and deflatable, portable sign support for supporting a sign, said support comprising:

a hollow air impervious inflatable casing having
an upper inflatable portion and
integral inflatable leg portions, having upper and lower ends, depending therefrom for supporting, when inflated, said upper inflatable portion in spaced relation with said lower ends of said leg portions;
one opening provided in said lower end of at least one of said leg portions;
means for closing said opening sealed to said lower end of said one of said leg portions;
means for admitting pressurized fluid to said casing to inflate said casing; and
decoration means for decorating said sign support comprising:
streamer means;
means for coupling said streamer means to said casing; and
fluid outlet valve means coupled to said casing adjacent said streamer for selectively controlling the egress of a portion of said fluid from said casing in a direction toward said streamer means.

8. An inflatable and deflatable, portable sign support for supporting a sign in spaced relation with a support surface comprising:

a hollow, inflatable, self-supporting, air impervious casing having
an upper inflatable portion, and
a pair of lower, laterally spaced apart inflatable leg portions depending therefrom and moveable between a collapsed, deflated condition and an upstanding inflated condition for supporting said upper inflatable portion in spaced relation with an underlying support surface;
means for admitting pressurized air to said casing to cause said leg portions to expand from said collapsed deflated condition to said inflated condition to raise said upper inflatable portion relative to said underlying support surface; and
means for mounting a media sign on said casing between said leg portions;
said casing comprising a hollow, inflatable cylindrical tube, said upper inflatable portion comprising an upper cylindrical tubular cross member;
said pair of inflatable leg portions comprising a pair of laterally spaced apart, inflatable cylindrical tubes integral with and depending from opposite ends of said tubular cross member;
said laterally spaced apart cylindrical tubes each including an upper end and a lower end; and
a plug sealed to said lower end of each of said laterally spaced tubes;
said means for admitting pressurized air including an opening provided in one of said plugs and an aligned opening provided in the lower end of one of said laterally spaced inflatable tubes.

9. An inflatable and deflatable, portable sign support for supporting a sign in spaced relation with a support surface comprising:

a hollow, inflatable, self-supporting, air impervious casing having
an upper inflatable portion, and
a pair of lower, laterally spaced apart inflatable leg portions depending therefrom and moveable between a collapsed, deflated condition and an upstanding inflated condition for supporting said upper inflatable portion in spaced relation with an underlying support surface;
means for admitting pressurized air to said casing to cause said leg portions to expand from said collapsed deflated condition to said inflated condition to raise said upper inflatable portion relative to said underlying support surface; and
means for mounting a media sign on said casing between said leg portions;
said casing comprising a hollow, inflatable cylindrical tube; said upper inflatable portion comprising an upper cylindrical tubular cross member,
said pair of inflatable leg portions comprising a pair of laterally spaced apart, inflatable cylindrical tubes integral with and depending from opposite ends of said tubular cross member;
said laterally spaced apart inflatable tubes include downwardly opening, lower open ends; and
a plug for sealing the lower open end of at least one of said laterally spaced apart inflatable tubes.

10. The inflatable and deflatable sign support set forth in claim 9 wherein said plug comprises a cylindrical side wall sealed to said lower end of said one laterally spaced apart inflatable tube.

11. An inflatable and deflatable, portable sign support comprising:

a one-piece, unitary, inverted U-shaped air impervious inflatable and deflatable casing having
a pair of hollow legs which each including upper and lower open ends and which, when inflated, are self-supporting and upstanding, and
a hollow cross member integral with and spanning said upper ends of said legs;
means closing the lower end of at least one of said legs to preclude the passage of air through said lower end of said one leg;
means for admitting sufficient air into the other one of said legs, adjacent the lower end thereof to maintain a static pressure within said casing in excess of the ambient atmospheric pressure; and
means on said legs for mounting a sign on said legs;
said means closing the lower end of at least one of said legs includes ballast means sealed to said lower end of said one leg.

12. The inflatable and deflatable sign support set forth in claim 11 wherein said ballast means includes an air impervious cylinder having a cylindrical side wall sealed to said lower end of said one leg.

13. The inflatable and deflatable sign support set forth in claim 12 wherein said ballast means includes an air impervious cylindrical plug having a cylindrical side wall sealed to the lower end of each leg.

14. The inflatable and deflatable sign support set forth in claim 13 wherein said means for admitting air includes an aperture through the lower end of the other of said legs and an aperture through said side wall of the adjacent cylinder sealed thereto; said apertures being aligned with each other.

15. The inflatable and deflatable sign support set forth in claim 12 wherein said ballest means is hollow and telescopingly received by said lower end of said one leg.

16. An inflatable and deflatable, portable sign support comprising:

a hollow inflatable tubular member, adapted to support a sign, having an upper inflatable cylindrical cross portion having opposite ends and a pair of inflatable cylindrical legs depending from said opposite ends of said upper cylindrical portion;

at least one of said legs including a closed air impervious lower end;

means for admitting pressurized fluid to said tubular member to inflate said tubular member; and means coupled to said pair of legs for mounting a sign between said legs;

each of said legs including a downwardly opening, open lower end; and plug means sealed to each of said open lower ends.

17. The inflatable and deflatable sign support set forth in claim 16 wherein each of said plug means includes a cylindrical side wall sealed to said lower ends of each of said legs.

18. An inflatable and deflatable, portable sign support for supporting a sign, said support comprising:

a hollow air impervious inflatable casing having an upper inflatable portion and integral inflatable leg portions, having upper and lower ends, depending therefrom for supporting, when inflated, said upper inflatable portion in spaced relation with said lower ends of said leg portions;

one opening provided in said lower end of at least one of said leg portions;

means for closing said opening sealed to said lower end of said one of said leg portions;

means for admitting pressurized fluid to said casing to inflate said casing;

said casing including at least one window portion which is transparent; and illuminating means disposed within said casing for illuminating said casing.

19. An inflatable and deflatable, portable sign support comprising:

an inverted U-shaped self-supporting, inflatable, air impervious hollow tube having a pair of open lower ends;

ballast means closing at least one of said open lower ends;

means for admitting pressurized fluid to said tube adjacent the other one of said lower ends to inflate said tube; and means for detachably mounting a sign on said tube;

said hollow tube including a pair of laterally spaced apart upstanding legs;

said means for detachably mounting a sign including means for mounting a sign between said upstanding legs;

said one lower end including a lower end portion;

said ballast means including an upstanding cylindrical side wall in abutting relation with said lower end portion of said tube adjacent said one lower end.

20. The sign support set forth in claim 19 wherein said other one of said lower ends includes an annular sidewall, having an air admitting aperture therethrough and including plug means having a cylindrical sidewall received by the other of said lower ends.

21. The sign support set forth in claim 20 wherein said plug means includes an air admitting opening therethrough in alignment with said air admitting aperture.

* * * * *